US007222842B2

(12) United States Patent
Lin

(10) Patent No.: US 7,222,842 B2
(45) Date of Patent: May 29, 2007

(54) VISE CLAMP

(76) Inventor: Chian Ling Lin, 6F.-10, No. 138, Sec. 1, Lyushun Rd., Beitun District, Taichung City (TW) 406

( * ) Notice: Subject to any disclaimer, the term of this patent is extended or adjusted under 35 U.S.C. 154(b) by 147 days.

(21) Appl. No.: 11/202,751

(22) Filed: Aug. 12, 2005

(65) Prior Publication Data

US 2007/0035075 A1 Feb. 15, 2007

(51) Int. Cl.
*B25B 1/00* (2006.01)

(52) U.S. Cl. ..... 269/6; 269/3; 269/166

(58) Field of Classification Search ..... 269/6, 269/3, 166, 170, 167, 43
See application file for complete search history.

(56) References Cited

U.S. PATENT DOCUMENTS 674,278 A * 5/1901 McNutt ..... 269/166
824,000 A * 6/1906 Elmer ..... 269/167

* cited by examiner

*Primary Examiner*—Robert C. Watson
(74) *Attorney, Agent, or Firm*—Banger Shia

(57) ABSTRACT

There is disclosed a vise clamp that can provide a large clamping force and be operated stably. The vise clamp includes a stationary jaw, a movable jaw connected to the stationary jaw, and a clamping device connected to the movable jaw. The clamping device includes a contact element moved up and down under the control of a lever. Two pinions are connected to the lever. Two pushers are provided besides the pinions. Each pusher includes a rack engaged with one of the pinions. The contact element is put against the pushers. As the lever is pivoted, the pinions are rotated. As the pushers are moved up by means of the pinions, the contact element is pushed up by means of the pushers. Thus, a workpiece can be clamped between a contact portion formed on the stationary jaw and the contact element connected to the movable jaw. Hence, the clamping force is large and the operation is stable.

7 Claims, 6 Drawing Sheets

VISE CLAMP

BACKGROUND OF INVENTION

1. Field of Invention

The present invention relates to a vise clamp

2. Related Prior Art

A vise clamp is primarily used in places where a vise cannot be used. For example, in processing planks, a vise clamp can be moved to various positions as desired by a user, but a vise cannot. A C-shaped vise clamp includes a body, a stationary jaw formed on the body, a screw installed on the body, and a movable jaw with a screw hole for receiving the screw. By means of rotating the screw, the movable jaw is moved up and down in order to clamp. For not including a retaining device, the C-shaped vise clamp often looses when subject to vibration. The following steps of the operation are thus affected. Moreover, the movable jaw can only be moved by means of rotating the screw, the speed of clamping is slowed. The smoothness of the operation is affected.

There has been devised a new C-shaped vise clamp including a stationary jaw, a movable jaw installed on the stationary jaw, and a clamping device connected to the movable jaw. The clamping device includes a lever formed with a cam. A ratchet mechanism is provided between the lever and the movable jaw. A contact element is put against the cam. Wishing to clamp a workpiece, a user moves the movable jaw so that the movable jaw reaches the workpiece. The user pivots the lever. The cam pushes the contact element. Thus, vise clamp clamps the workpiece. The ratchet mechanism is supposed to retain the lever and therefore the contact element in position. The pivotal of the lever is faster than the rotation of a screw.

In the foregoing C-shaped vise clamp, the cam formed on the lever is used to clamp; however, it causes an inadequate stroke of the movement of the contact element and therefore an adequate clamping force. The clamping force is particularly inadequate when it is used to clamp an elastic workpiece. Moreover, the abutment of the cam against the contact element affects the position of the contact element so that the contact element may not fully contact a workpiece. Hence, the clamping is not stable. Hence, there is room for improvements.

The present invention is therefore intended to obviate or at least alleviate the problems encountered in prior art.

SUMMARY OF INVENTION

The primary objective of the present invention is to provide a vise clamp that can provide a large clamping force and be operated stably.

According to the present invention, a vise clamp includes a stationary jaw and a movable jaw put on the stationary jaw. The movable jaw includes an ear formed with ratchets. A lever is formed with two ears connected to the ear of the movable jaw. A pawl is connected to the lever and formed with ratchets for engagement with the ratchets of the movable jaw. Two pinions are connected to the ears of the lever. Two pushers sandwich the pinions, and each includes a slot defined therein and a rack engaged with one of the pinions so that the pushers are moved as the pinions are rotated. A contact element is put against the pushers so that the former can be pushed by means of the latter. The contact element includes two ears sandwiching the pushers. Each of the ears of the contact element defines a slot. A shaft is driven through the ear of the movable jaw, the ears of the lever and the pinions so that they are rotated together with one another. The slots of the pushers and the slots of the contact element receive the shaft in order to allow movement of the pushers and the contact element relative to the shaft.

Other advantages and novel features of the invention will become more apparent from the following detailed description in conjunction with the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
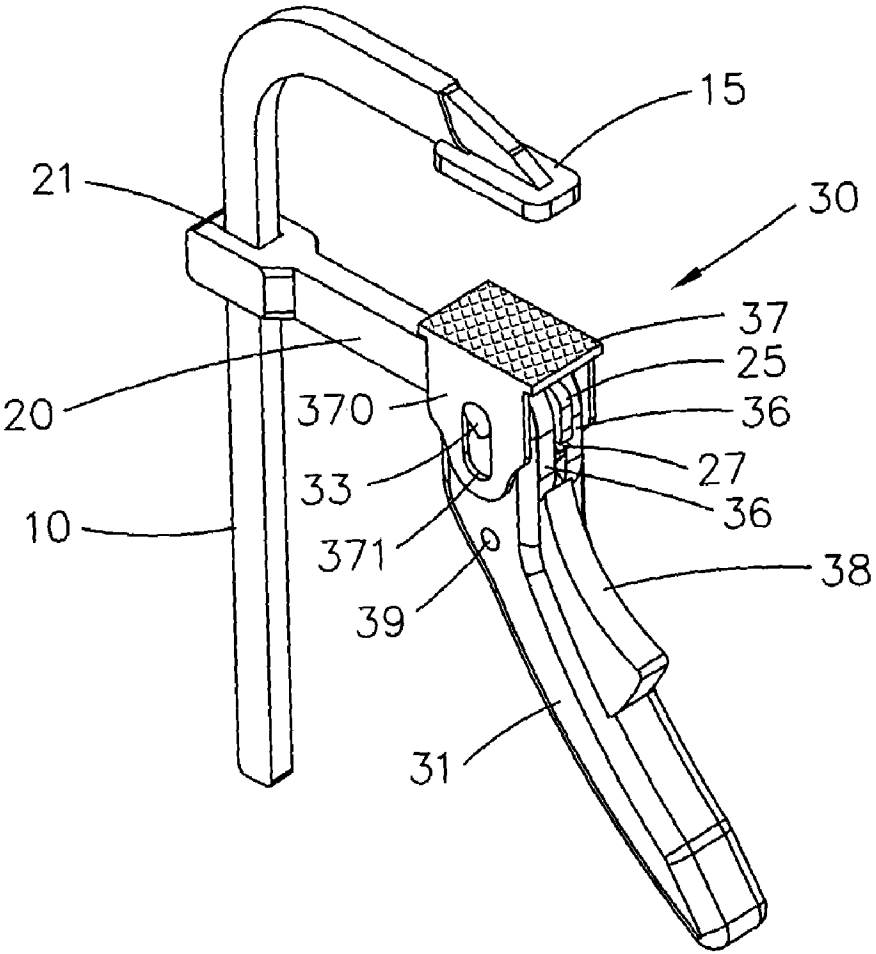
FIG. 1 is a perspective view of a vise clamp according to the preferred embodiment of the present invention.
Figure 2:
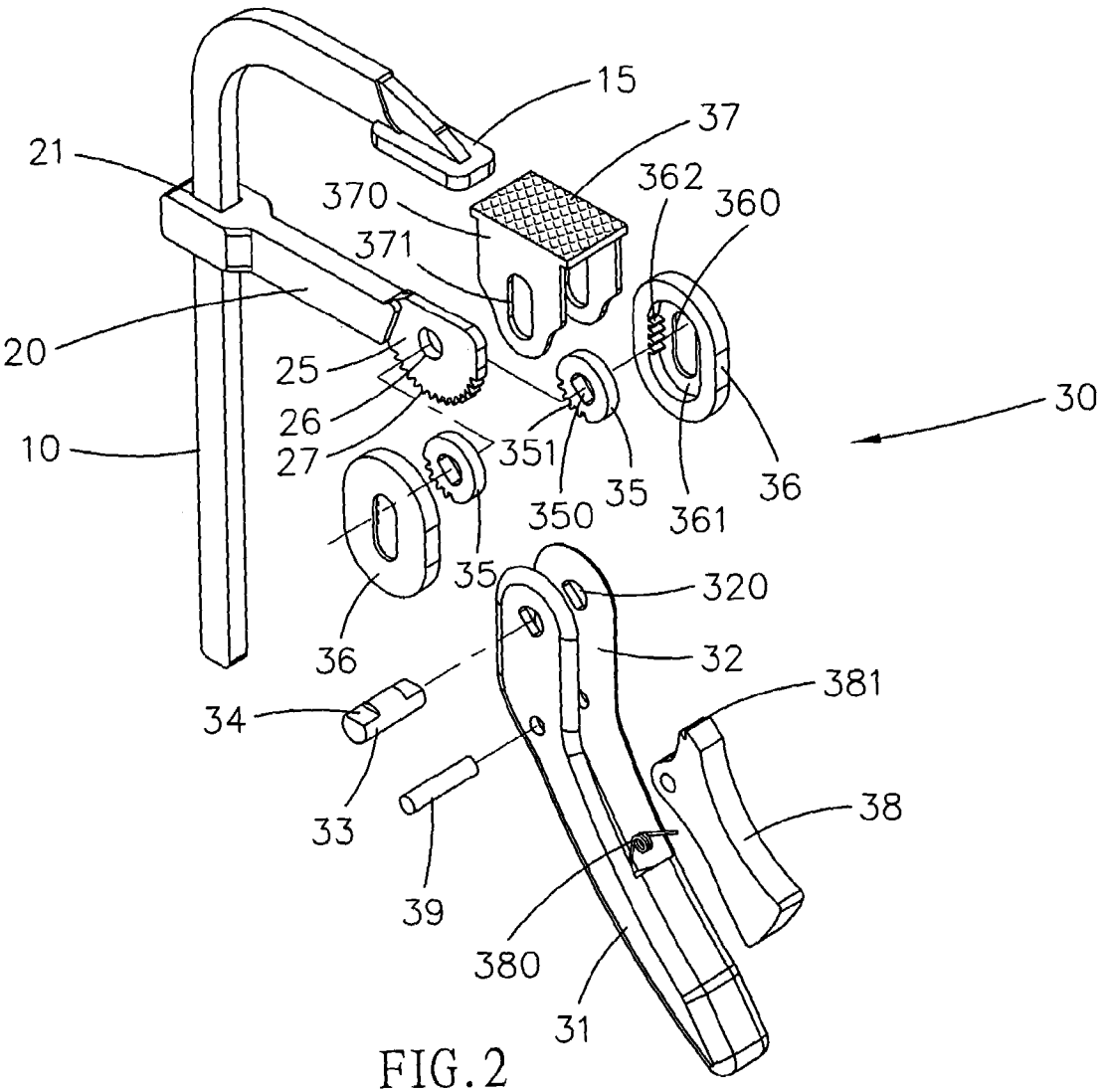
FIG. 2 is an exploded view of the vise clamp shown in FIG. 1.
Figure 3:
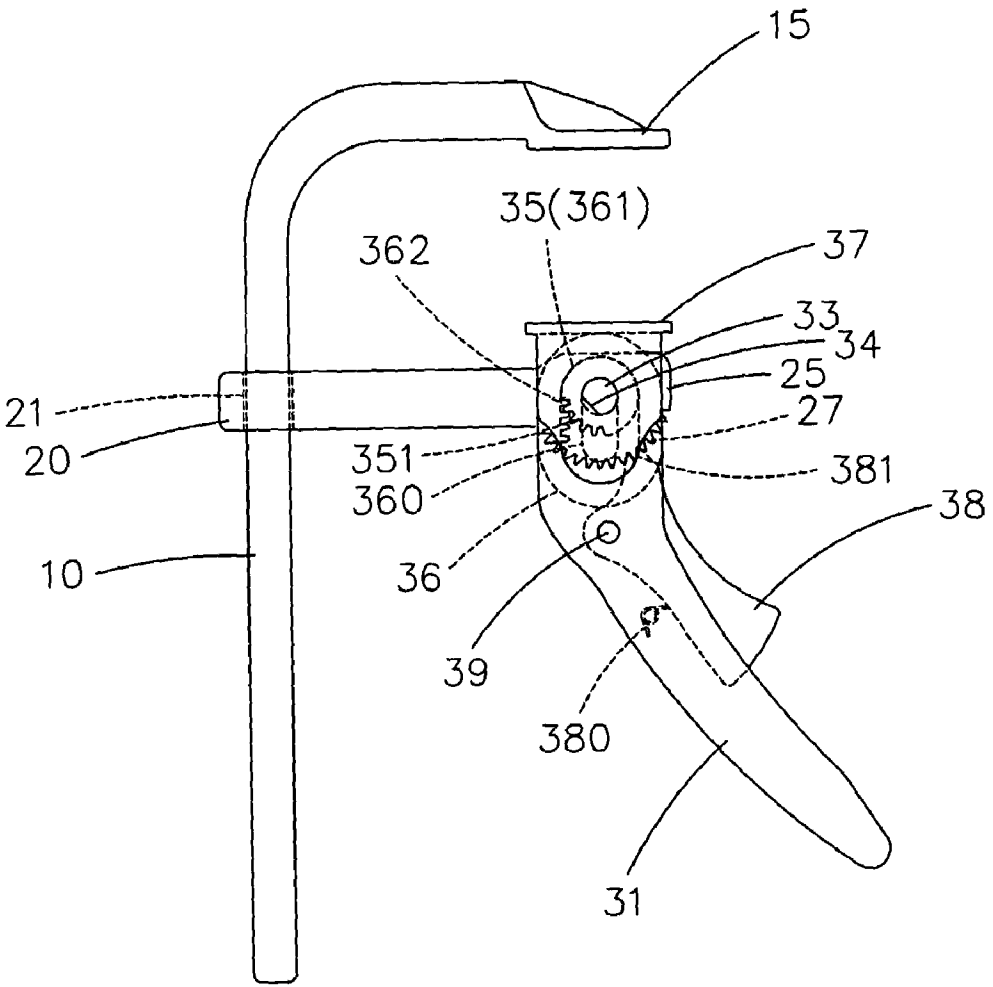
FIG. 3 is a side view of the vise clamp shown in FIG. 1.
Figure 4:
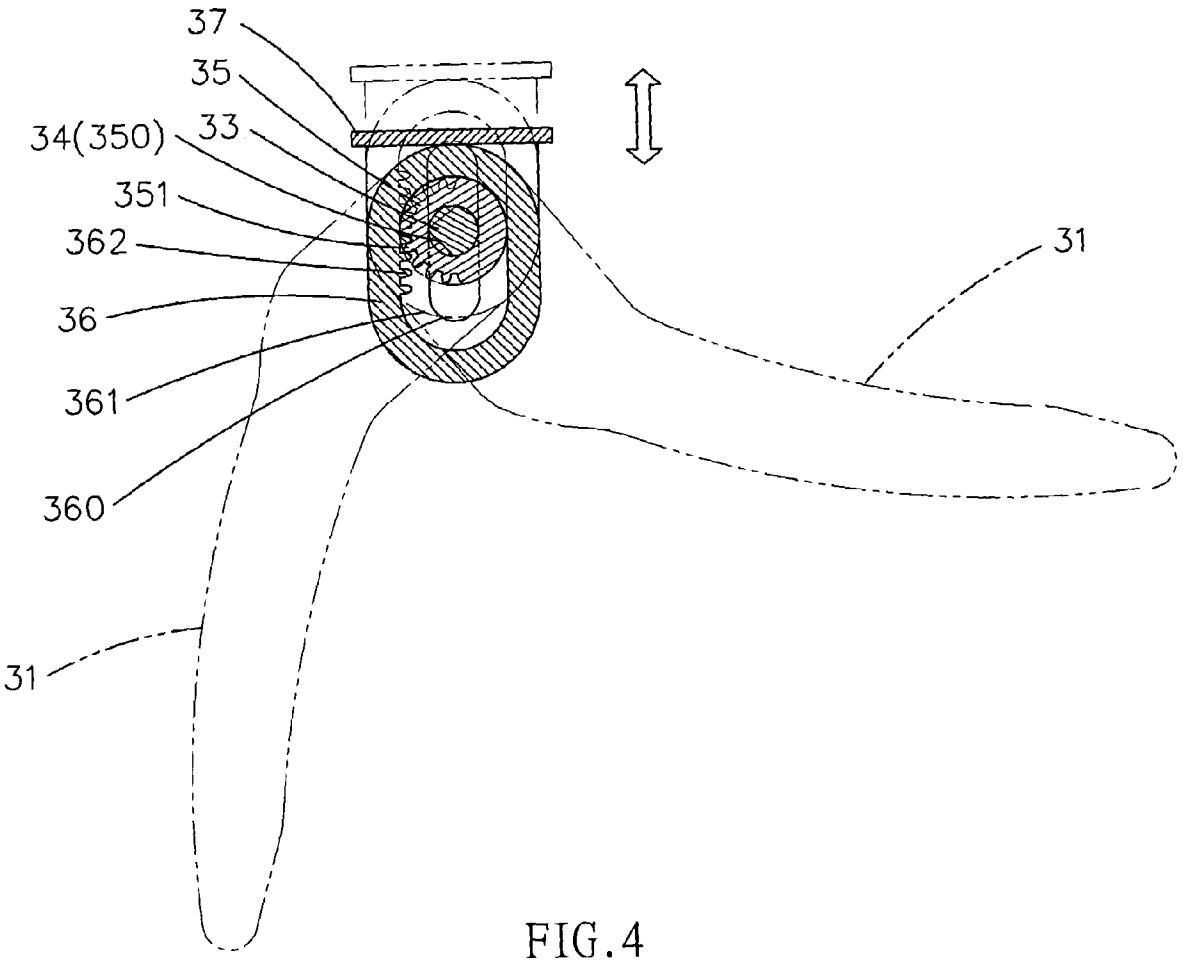
FIG. 4 is a cross-sectional partial view of the vise clamp of FIG. 3.
Figure 5:
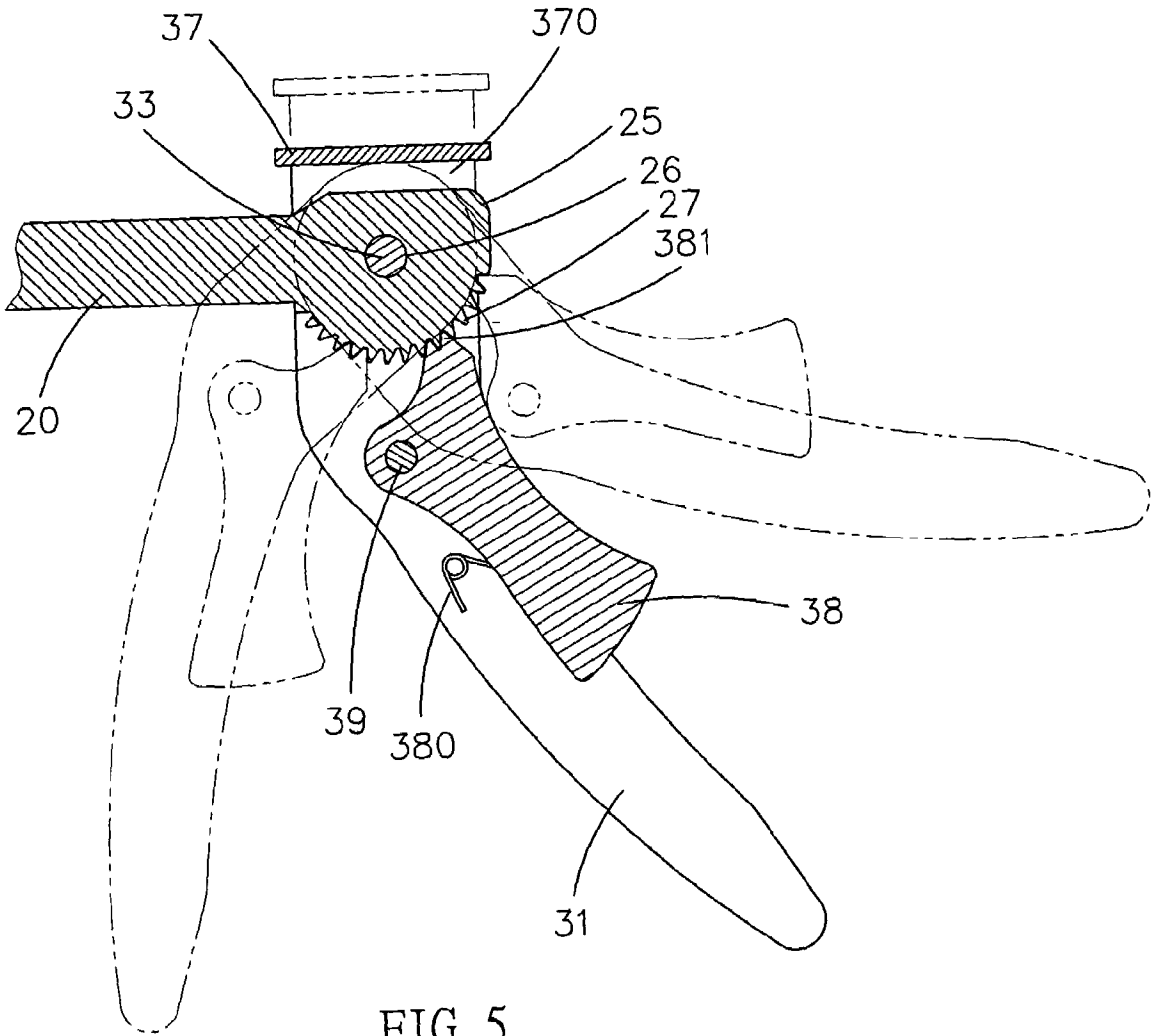
FIG. 5 is another cross-sectional partial view of the vise clamp shown in FIG. 3.
Figure 6:
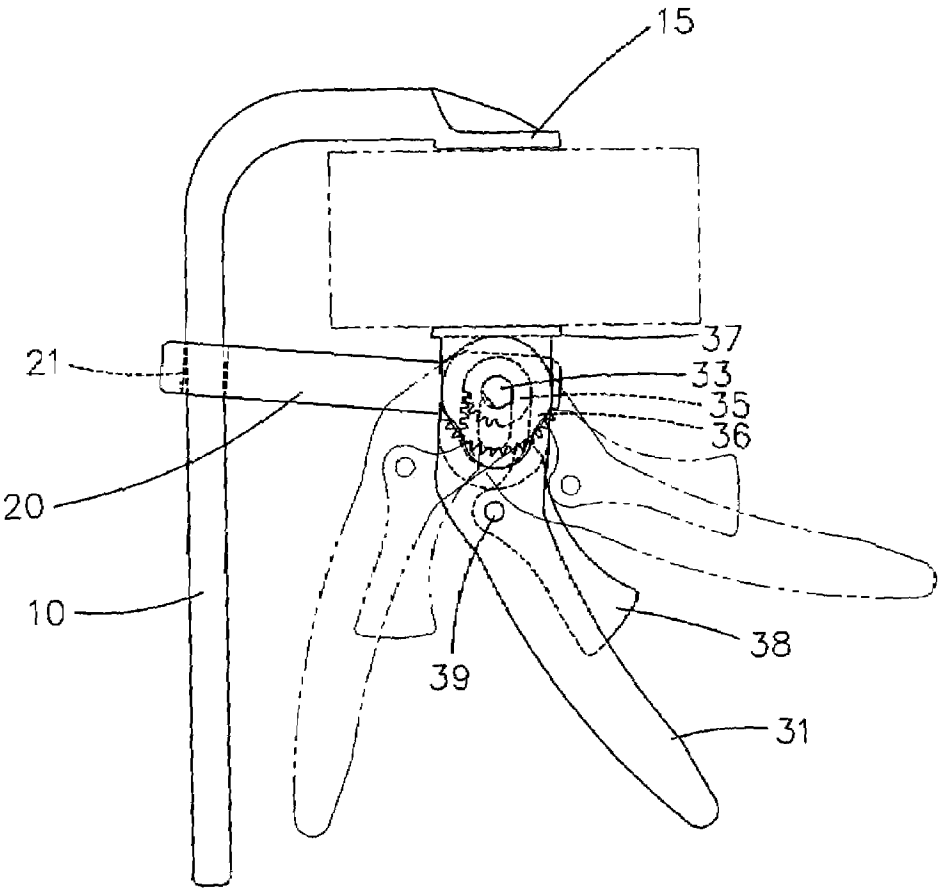
FIG. 6 is a side view of a workpiece clamped by means of the vise clamp shown in FIG. 3.

Referring to FIGS. 1 and 2, there is shown a vise clamp according to the preferred embodiment. The vise clamp includes a stationary jaw 10, a movable jaw 20 and a clamping device 30. The stationary jaw 10 is inverted L-shaped, i.e., including a first section and a second section perpendicular to the first section. A contact portion 15 is formed on the first section of the stationary jaw 10. In a sliding manner, the second section of the stationary jaw 10 is inserted through an aperture 21 defined in the movable jaw 20. The clamping device 30 is connected to the movable jaw 20. The clamping device 30 includes a contact element 37 controlled by means of a lever 31.

The movable jaw 20 includes, at an end, an ear 25 to which the clamping device 30 is connected. The ear 25 includes an aperture 26 defined therein and a series of ratchets 27 formed along the periphery of the ear 25. The lever 31 includes, at an end, two ears 32 corresponding to the ear 25 of the movable jaw 20. Each ear 32 defines a non-circular aperture 320. A shaft 33 includes two non-circular ends 34 compliant to the non-circular apertures 320. The shaft 33 is inserted through the aperture 26. The non-circular ends 34 of the shaft 33 are fit in the non-circular apertures 320 of the lever 31. Thus, the lever 31 is connected to the movable jaw 20, and the shaft 33 will be rotated together with the lever 31. Each non-circular end 34 of the shaft 33 is fit in a non-circular aperture 350 defined in a pinion 35. Teeth 351 are formed along the periphery of each pinion 35.

The clamping device 30 includes two pushers 36 provided beyond the pinions 35. Each pusher 36 includes a slot 360 defined therein, a space 361 communicated with the slot 360 and a rack 362 formed on the wall of the space 361. The racks 362 are engaged with the pinions 35 so that the pushers 36 are moved as the pinions 35 are rotated. The contact element 37 includes two ears 370 formed on two sides and located beyond the pushers 36. Each ear 370 defines a slot 371 for receiving the shaft 33. Thus, the contact element 37 can be moved by means of the pushers 36. A pawl 38 is pivotally connected to the lever 31 by means of a pin 39. A spring 380 is put between the pawl 38 and the lever 31. The pawl 38 includes, at an end, ratchets 381 for engagement with the ratchets 27 of the ear 25. Thus, after pivoted, the lever 31 is retained in position by means of the pawl 38.

As discussed above, the vise clamp according to the present invention can provide a large clamping force and be operated stably.

Referring to FIGS. 3 through 6, the operation of the vise clamp will be described. Wishing to clamp a workpiece, a user put the workpiece between the contact portion 15 of the stationary jaw 10 and the contact element 37 connected to the movable jaw 20. The user moves the movable jaw 20 up so that the contact element 37 contacts the workpiece. The user pivots the lever 31 and therefore the shaft 33. The shaft 33 pivots the pinions 35. By means of the engagement of the pinions 35 with the racks 362, the pinions 35 move the pushers 36 up. In turn, the pushers 36 push the contact element 37 up. Simultaneously, the movable jaw 20 is tilted in order to hold on to the stationary jaw 10. The contact element 37 continues to move up so that its top fully contacts the bottom of the workpiece. The contact element 37 continues to move up so that the vise clamp tightly clamps the workpiece. The clamping force is large. The operation is stable. Because the second section of the stationary jaw 10 is long, the range of thicknesses of workpieces that can be clamped by means of the vise clamp is large.

The present invention has been described through the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A vise clamp comprising:

a stationary jaw (10);

a movable jaw (20) put on the stationary jaw (10), the movable jaw (20) comprising an ear (25) formed with ratchets (27);

a lever (31) comprising two ears (32) connected to the ear (25) of the movable jaw (20);

a pawl (38) connected to the lever (31), the pawl (38) comprising ratchets (381) formed thereon for engagement with the ratchets (27) of the movable jaw (20);

two pinions (35) connected to the ears (32) of the lever (31);

two pushers (36) sandwiching the pinions (35) and each comprising a slot (360) defined therein and a rack (362) engaged with one of the pinions (35) so that the pushers (36) are moved as the pinions are rotated;

a contact element (37) put against the pushers (36) so that the former can be pushed by means of the latter, the contact element (37) comprising two ears (370) sandwiching the pushers (36), each of the ears (370) of the contact element (37) defining a slot (36);

a shaft (33) driven through the ear (25) of the movable jaw (20), the ears (32) of the lever (31) and the pinions (35) so that they are rotated together with one another, wherein the slots (360) of the pushers (36) and the slots (371) of the contact element (37) receive the shaft (33) in order to allow movement of the pushers (36) and the contact element (37) relative to the shaft (33).

2. The vise clamp according to claim 1 wherein the stationary jaw (10) comprises a contact portion (15) formed thereon corresponding to the contact element (37).

3. The vise clamp according to claim 1 wherein each of the ears (32) of the lever (31) defines a non-circular aperture (320), wherein each of the pinions (35) defines a non-circular aperture (350), wherein the shaft (33) comprises two non-circular ends (34) fit in the non-circular apertures (320) of the ears (32) of the lever (31) and the non-circular apertures (350) of the pinions (35).

4. The vise clamp according to claim 1 comprising a spring (380) provided between the lever (31) and the pawl (38).

5. The vise clamp according to claim 1 comprising a pin (39) for connecting the pawl (38) to the lever (31).

6. The vise clamp according to claim 1 wherein each of the pushers (36) defines a space (361) for containing one of the pinions (35).

7. The vise clamp according to claim 6 wherein for each of the pushers (36), the rack (362) is formed on the wall of the space (361).

* * * * *